US009455490B2

(12) United States Patent
Huang et al.

(10) Patent No.: US 9,455,490 B2
(45) Date of Patent: Sep. 27, 2016

(54) COMMUNICATION DEVICE INTEGRALLY FORMED WITH ANTENNA AND MASK

(71) Applicant: Sercomm Corporation, Tapei (TW)

(72) Inventors: Yuan-Heng Huang, Taichung (TW); Ching-Lin Chu, New Taipei (TW); Chung-Yen Hsiao, Hsinchu (TW)

(73) Assignee: SERCOMM CORPORATION, Taipei (TW)

( * ) Notice: Subject to any disclaimer, the term of this patent is extended or adjusted under 35 U.S.C. 154(b) by 344 days.

(21) Appl. No.: 13/938,267

(22) Filed: Jul. 10, 2013

(65) Prior Publication Data

US 2014/0118197 A1 May 1, 2014

(30) Foreign Application Priority Data

Oct. 26, 2012 (CN) ..... 2012 2 0557682

(51) Int. Cl.

| | |
|---|---|
| ***H01Q 1/42*** | (2006.01) |
| ***H01Q 9/42*** | (2006.01) |
| ***H01Q 1/24*** | (2006.01) |
| ***H01Q 1/48*** | (2006.01) |
| ***H01Q 21/28*** | (2006.01) |

(52) U.S. Cl.

CPC ..... *H01Q 1/24* (2013.01); *H01Q 1/42* (2013.01); *H01Q 1/48* (2013.01); *H01Q 9/42* (2013.01); *H01Q 21/28* (2013.01)

(58) Field of Classification Search

CPC ..... H01Q 1/22–1/248; H01Q 1/2258; H01Q 1/2266; H01Q 1/2275; H01Q 1/2283; H01Q 1/2291; H01Q 1/52; H01Q 1/526; H01Q 1/44; H01Q 9/04–9/43; H05K 9/00

See application file for complete search history.

(56) References Cited

U.S. PATENT DOCUMENTS

| | | | | |
|---|---|---|---|---|
| 6,014,113 | A * | 1/2000 | Orchard et al. | 343/841 |
| 6,448,933 | B1 * | 9/2002 | Hill | H01Q 1/22 343/702 |
| 6,670,926 | B2 * | 12/2003 | Miyasaka | G06F 1/1616 343/702 |
| 7,277,057 | B2 * | 10/2007 | Schaffer | 343/702 |
| 7,504,998 | B2 * | 3/2009 | Choi | H01Q 1/22 343/700 MS |
| 7,570,218 | B2 * | 8/2009 | Tsujimura | G06F 1/1616 343/700 MS |
| 7,728,780 | B2 * | 6/2010 | Ishida | H01Q 1/2266 343/702 |
| 8,269,671 | B2 * | 9/2012 | Chen | H01L 23/04 343/700 MS |
| 2004/0108958 | A1 * | 6/2004 | Sun | 343/702 |
| 2004/0217472 | A1 * | 11/2004 | Aisenbrey et al. | 257/734 |
| 2008/0143608 | A1 * | 6/2008 | Watanabe | H01Q 1/088 343/700 MS |

* cited by examiner

*Primary Examiner* — Sue A Purvis
*Assistant Examiner* — Patrick Holecek
(74) *Attorney, Agent, or Firm* — McClure, Qualey & Rodack, LLP

(57) ABSTRACT

A communication device integrally formed with antenna and mask is provided. The communication device comprises a circuit board, a frame, a communication chip and a mask. The frame is disposed on an upper surface of the circuit board. The frame has multiple sidewalls perpendicular to the upper surface and surrounding an opening. The communication chip is disposed on the upper surface and located in the opening. The mask is disposed on the circuit board, comprises a cover, multiple plates and an antenna module. The cover covers the communication chip. The plate is projected from a lower edge of the cover and parallel to the sidewalls, and has a hollowed area. The antenna module is connected to the hollowed area and integrally formed with the plate in one piece.

8 Claims, 3 Drawing Sheets

COMMUNICATION DEVICE INTEGRALLY FORMED WITH ANTENNA AND MASK

This application claims the benefit of People's Republic of China application Serial No. 201220557682.2, filed Oct. 26, 2012, the subject matter of which is incorporated herein by reference.

BACKGROUND OF THE INVENTION

1. Field of the Invention

The invention relates in general to a communication device, and more particularly to a communication device integrally formed with antenna and mask.

2. Description of the Related Art

With the advance in technology, communication products are getting more and more popular in people's everyday life. In a communication product, electromagnetic interference may easily occur between the antenna, the chip, and the circuit of a circuit board. Normally, a mask is used to control the induction and radiation of electrical field, magnetic field and electromagnetic waves between two regions to avoid the electromagnetic field of interference sources interfering with the electromagnetic field of the circuit, such that the communication products can be conformed to related standards of the test in the interference of electromagnetic waves.

Apart from the electromagnetic interference which can be resolved by using a mask, the communication product still need to have the dissipation function to resolve the heat generated by the communication chip. Besides, the antenna coupling problem also needs to be considered. Normally, the three problems regarding antenna operation, heat dissipation and electromagnetic interference need to be treated separately. However, the solutions to the three problems often conflict with one another. For example, an aluminum dissipation piece used to resolve the dissipation problem may interfere with the operation of the antenna. Since the solutions for the three problems are independent, the manufacturing of communication products is thus time consuming and expensive.

In general, an antenna needs to pass related tests. After the antenna is installed in a communication product, an overall test is required. The overall test has two processes, not only requiring longer manufacturing time but also incurring higher manufacturing cost. Moreover, the proficiency of installing the antenna to the communication product will affect the reliability of the final product.

SUMMARY OF THE INVENTION

The invention is directed to a communication device integrally formed in one piece through the design of connecting an antenna module to a hole in a hollowed area of a mask to simplify the manufacturing process.

According to an embodiment of the present invention, a communication device integrally formed with antenna and mask is provided. The communication device comprises a circuit board, a frame, a communication chip and a mask. The frame is disposed on an upper surface of the circuit board. The frame has multiple sidewalls perpendicular to the upper surface and surrounding an opening. The communication chip is disposed on the upper surface and located in the opening. The mask is disposed on the circuit board, comprises a cover, multiple plates and an antenna module. The cover covers the communication chip. The plates are projected from a lower edge of the cover and parallel to the sidewalls, and has a hollowed area. The antenna module is connected to the hollowed area and integrally formed with the plates in one piece.

The above and other aspects of the invention will become better understood with regard to the following detailed description of the preferred but non-limiting embodiment (s). The following description is made with reference to the accompanying drawings.

DETAILED DESCRIPTION OF THE INVENTION

First Embodiment

Figure 1:
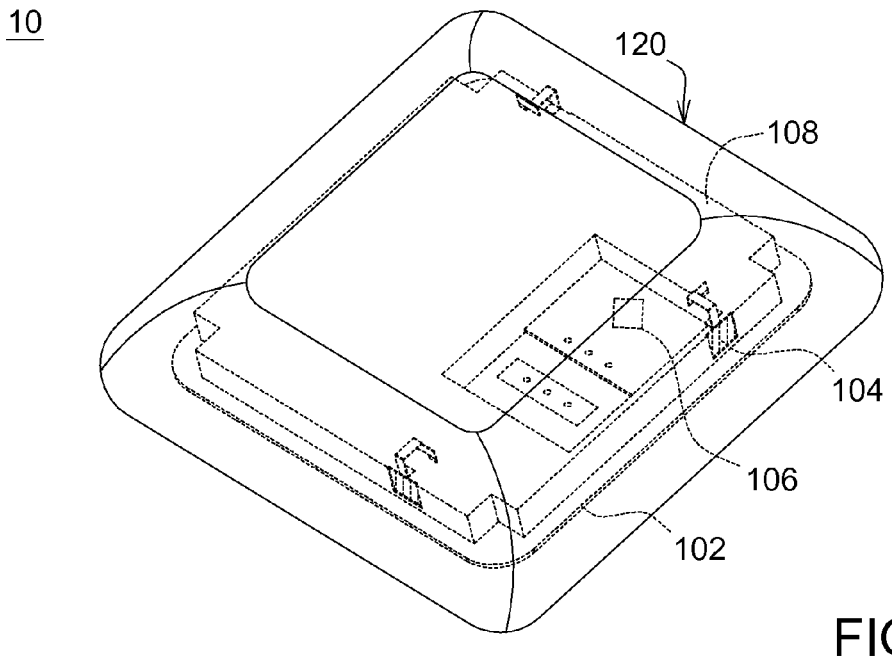
FIG. 1 shows a communication device according to an embodiment of the disclosure.

FIG. 1 shows a communication device 10 according to an embodiment of the disclosure. The communication device 10 is such as a network communication device, and may comprise an optical fiber product such as WiFi, long term evolution (LTE) technology, femtocell, and integrated access device (IAD), etc. Referring to FIG. 1, the communication device 10 comprises a circuit board 102, a frame 104, a communication chip 106, a mask 108 and a housing 120. The housing 120 encapsulates the communication module 100 (illustrated in FIG. 2A and FIG. 2B).

Figure 2A:
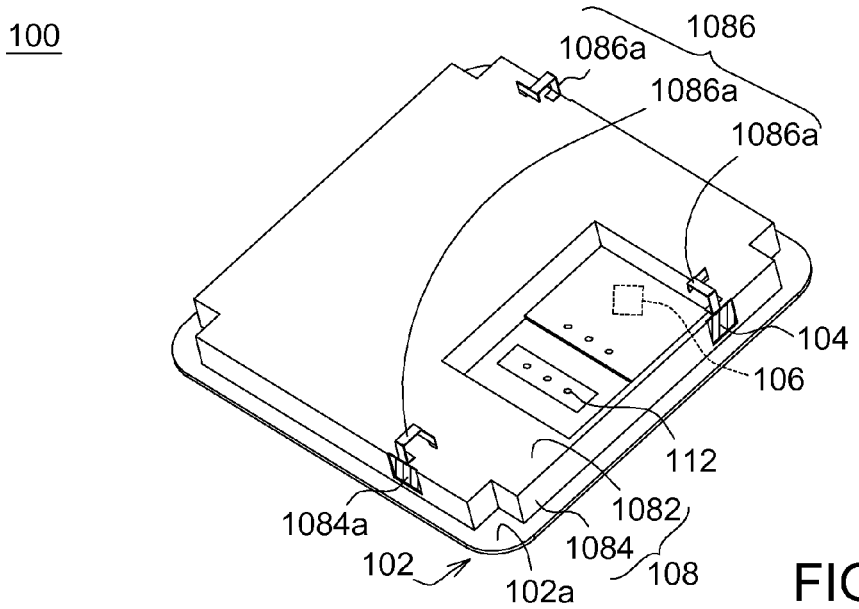
FIG. 2A shows a communication module 100 according to an embodiment of the disclosure.
Figure 2B:
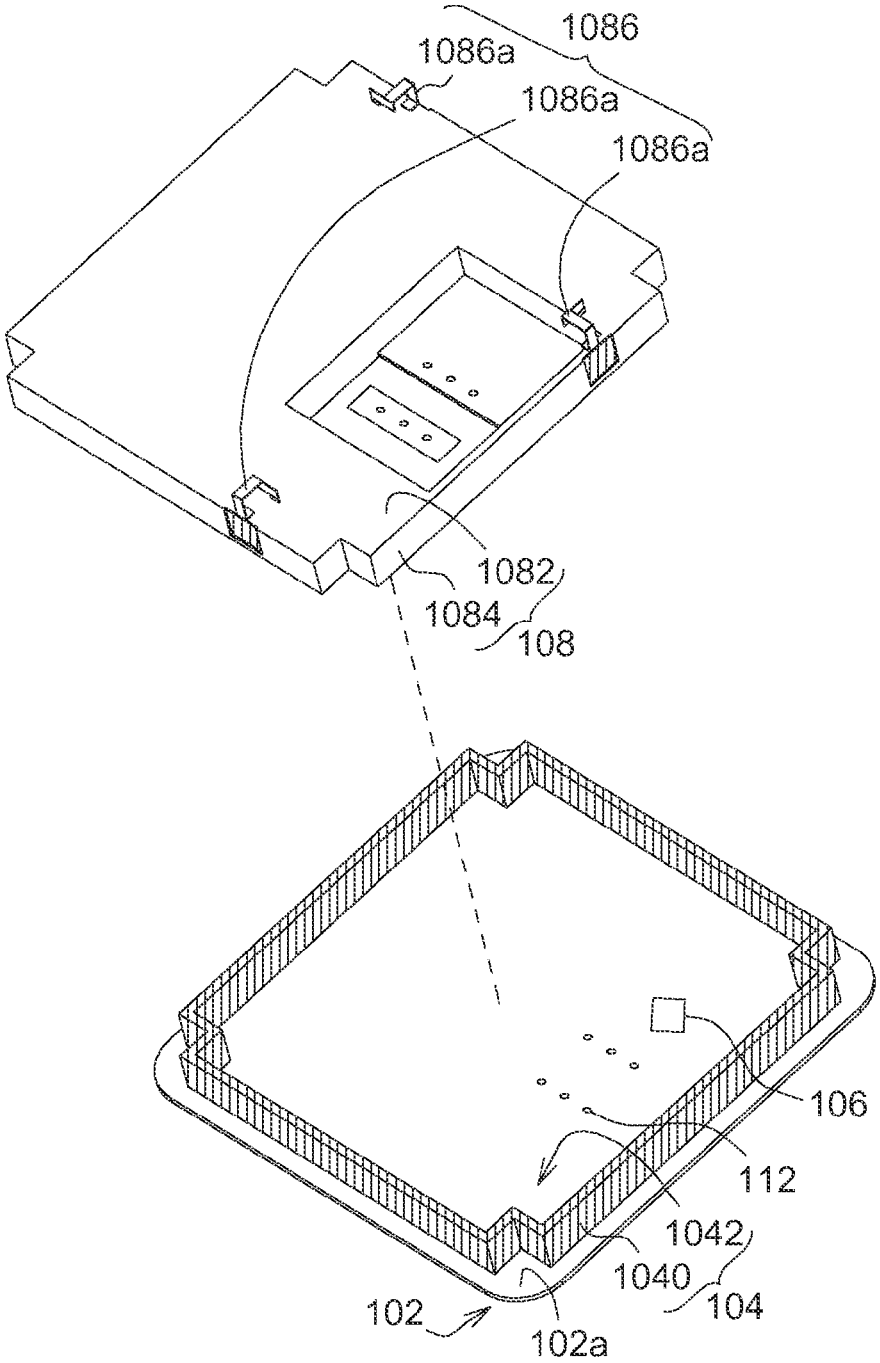
FIG. 2B shows an explosion diagram of a communication module according to an embodiment of the disclosure.

FIG. 2A shows a communication module 100 according to an embodiment of the disclosure. FIG. 2B shows an explosion diagram of a communication module 100 according to an embodiment of the disclosure. Referring to FIG. 2A and FIG. 2B. The communication module 100 comprises a circuit board 102, a frame 104, a communication chip 106 and a mask 108.

In the present embodiment, the frame 104 is disposed on an upper surface 102*a* of the circuit board 102. The frame 104 has multiple sidewalls 1040 perpendicular to the upper surface 102*a* and surrounding an opening 1042. The sidewalls 1040, formed by such as metal, can be soldered on the bare copper of the upper surface 102*a* of the circuit board 102 and connected to the upper surface 102*a* of the circuit board 102. The communication chip 106, disposed on the upper surface 102*a* and located in the opening 1042, is electrically connected to the circuit board 102.

As indicated in FIG. 2A, the mask 108 disposed on the circuit board 102 can be formed by such as metal, and can be used as a reference ground surface of a radiation element to increase the efficiency of radiation. The mask 108 may comprise a cover 1082, multiple plates 1084 and an antenna module 1086. The cover 1082 covers the communication chip 106. The plate 1084 is projected from a lower edge of the cover 1082 and parallel to sidewalls 1040 (FIG. 2B). At least one of the plates 1084 has a hollowed area 1084*a* to which the antenna module 1086 is connected.

The antenna module 1086 may comprise one or multiple antennas 1086*a*. The quantities and types of the antennas 1086*a* are related to the dimension of the communication module 100, and are not subjected to any particular restrictions. The antenna module 1086 of FIGS. 2A or 2B comprises a monopole antenna 1086*a*, and the antenna 1086*a* of the antenna module 1086 is extended to the hollowed area 1084*a*.

Furthermore, after a particular region of the plate 1084 is patterned and cut, the patterned cutting position is folded upward to form an antenna 1086*a*, and the notch position caused by the folding process forms a hollowed area 1084*a*. Therefore, the antenna 1086*a* of the antenna module 1086 and the hollowed area 1084*a* of the plate 1084 are integrally formed in one piece. In an embodiment, the dimension of the hollowed area 1084*a* may correspond to the dimension of the antenna module 1086. Due to the results of patterning and folding, the dimension of the hollowed area 1084*a* may be different from the dimension of the antenna module 1086, but the invention is not limited thereto.

In general, high-frequency noises are transmitted by two ways: radiation and conduction, hence affecting the stability of peripheral systems. In an embodiment, the plate 1084 of the mask 108 is tightly disposed on the sidewalls 1040 of the frame 104 (FIG. 2B), such that the mask 108 can be fixedly disposed and surrounding the outer sides of the sidewalls 1040 of the frame 104. The sidewalls 1040 of the frame 104 can cover the hollowed area 1084*a* of the plate 1084, and the structure of the mask 108 and the frame 104 can completely isolate electromagnetic waves and contain the noises at the space between the mask 108 and the sidewalls 1040. By doing so, electromagnetic interference will not occur between the elements inside and the elements outside the mask 108, such that unnecessary noises will not be coupled to the antenna by way of radiation and received by the antenna which further transmits the noises to the radio frequency transceiver circuit and affects system stability.

As shown in an embodiment of FIG. 2A, the part by the cover 1082 of the mask 108 corresponding to the communication chip 106 is depressed towards the communication chip 106, and the heat generated by the communication chip 106 can be dissipated to the environment through the large contact area between the cover 1082 of the mask 108 and the communication chip 106. In an embodiment, the thickness of the mask 108 can be larger than 0.5 mm to increase the cross-section of heat conduction.

As indicated in FIG. 2A, the circuit board 102 has a lower surface opposite to the upper surface 102*a* (the lower surface is blocked by the upper surface 102*a* and is not illustrated). In an embodiment, a fixing piece 112, such as a screw or other locking element, penetrates to the upper surface 102*a* from the lower surface (not illustrated) of the circuit board 102 and fixes the circuit board 102 and the cover 1082 of the mask 108, such that the cover 1082 of the mask 108 tightly contacts the communication chip 106 and the heat generated by the communication chip 106 can be transmitted to the environment through the cover 1082 and the dissipation effect can thus be increased.

Second Embodiment

Figure 3:
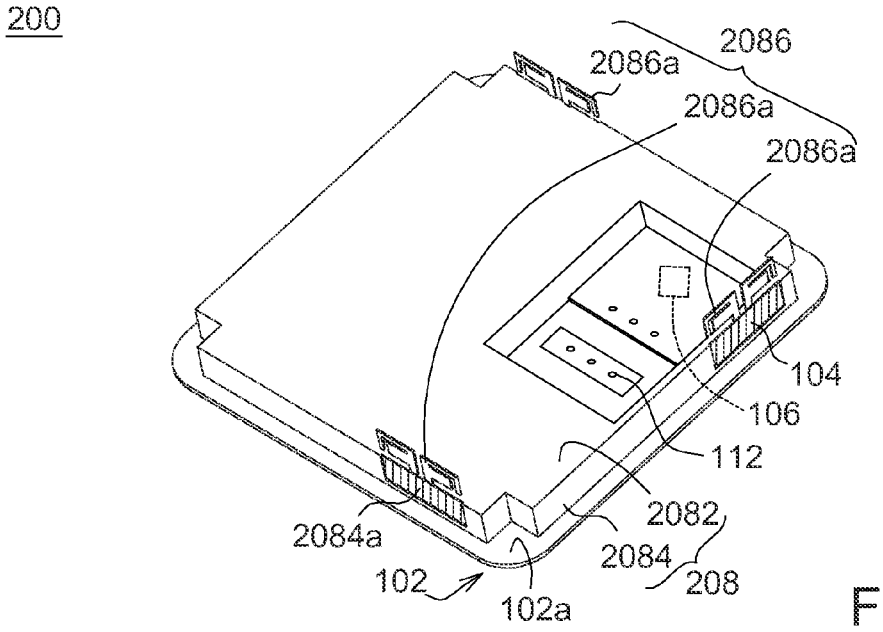
FIG. 3 shows a schematic diagram of a communication module according to an embodiment of the disclosure.

FIG. 3 shows a schematic diagram of a communication module 200 according to an embodiment of the disclosure. The communication module 200 may replace the communication module 100 and be disposed on the communication device 10. Referring to FIG. 3. The communication module 200 comprises a circuit board 102, a frame 104, a communication chip 106, a fixing piece 112 and a mask 208. In the present embodiment, the communication module 200 is similar to the communication module 100 of FIGS. 2A and 2B, and common components retain the same numeric designations and are not repeated here.

As indicated in FIG. 3, the mask 208, disposed on the circuit board 102 and formed by such as metal, may comprise a cover 2082, multiple plates 2084 and an antenna module 2086. At least one of the plates 2084 has a hollowed area 2084*a* to which the antenna module 2086 is connected. The disposition of the cover 2082 and the plate 2084 can be the same as that of the first embodiment.

The antenna module 2086 may comprise one or multiple antennas 2086*a*. The quantities and types of antennas 2086*a* are related to the dimension of the overall communication module 200, and are not subjected to any particular restrictions. The communication module 200 is different from the communication module 100 mainly in the type of the antenna module 2086 of the communication module 200. The antenna module 2086 of FIG. 3 comprises a dipole antenna 2086*a* extended to the hollowed area 2084*a*.

Furthermore, after a particular region of the plate 2084 is patterned and cut, the patterned cutting position is folded upward to form an antenna 2086*a*, and the notch position caused by way of folding forms a hollowed area 2084*a*. Therefore, the antenna 2086*a* of the antenna module 2086 and the hollowed area 2084*a* of the plate 2084 are integrally formed in one piece. In an embodiment, the dimension of the hollowed area 2084*a* may correspond to the dimension of the antenna 2086*a*, but the invention is not limited thereto.

In an embodiment, the plate 2084 of the mask 208 is tightly disposed on the sidewalls 1040 of the frame 104 (FIG. 2B), such that the mask 208 can be fixedly disposed and surrounding the outer sides of the sidewalls 1040 of the frame 104. Thus, the sidewalls 1040 of the frame 104 can cover the hollowed area 2084*a* of the plate 2084, and the structure of the mask 208 and the frame 104 can completely isolate electromagnetic waves to avoid electromagnetic interference being generated between the elements inside and the elements outside the mask 208.

Third Embodiment

Figure 4:
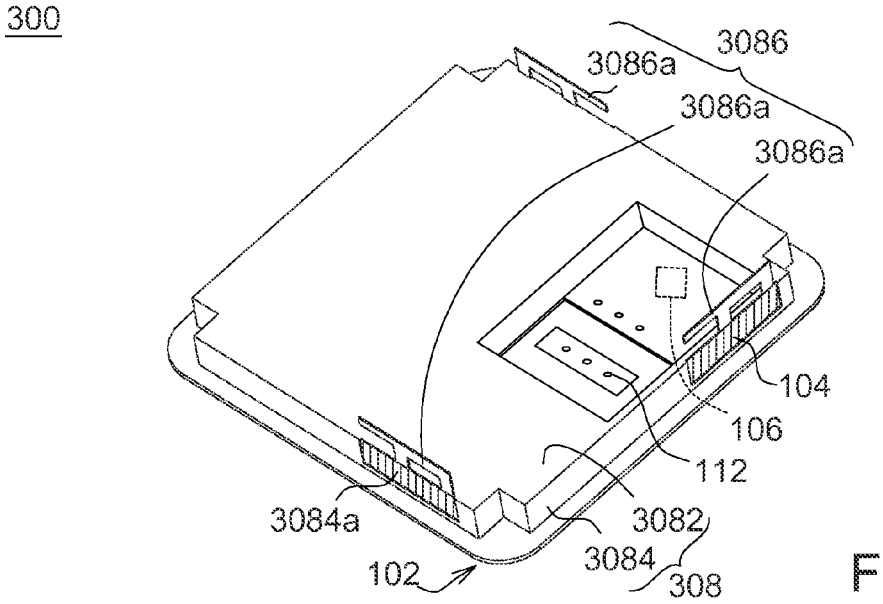
FIG. 4 shows a schematic diagram of a communication module according to an embodiment of the disclosure.

FIG. 4 shows a schematic diagram of a communication module 300 according to an embodiment of the disclosure. The communication module 300 may replace the communication module 100 and be disposed on the communication device 10. Referring to FIG. 4. The communication module 300 comprises a circuit board 102, a frame 104, a communication chip 106, a fixing piece 112 and a mask 308. In the present embodiment, the communication module 300 is similar to the communication module 100 of FIGS. 2A and 2B, and common components retain the same numeric designations and are not repeated here.

As indicated in FIG. 4, the mask 308 disposed on the circuit board 102 and formed by such as metal may comprise a cover 3082, multiple plates 3084 and an antenna module 3086. At least one of the plates 3084 has a hollowed area 3084*a* to which the antenna module 3086 is connected. The disposition of the cover 3082 and the plate 3084 can be the same as that of the first embodiment.

The antenna module 3086 may comprise one or multiple antennas 3086*a*. The quantities and types of antenna 3086*a* are related to the dimension of the overall communication module 300, and are not subjected to any particular restrictions. The communication module 300 is different from the communication module 100 mainly in the type of the antenna module 3086 of the communication module 300. The antenna module 3086 of FIG. 4 comprises a planar inverted F-type (dipole) antenna 3086*a* extended to the hollowed area 3084*a*.

Furthermore, after a particular region of the plate 3084 is patterned and cut, the patterned cutting position is folded upward to form an antenna 3086*a*, and the notch position caused by way of folding forms a hollowed area 3084*a*. Therefore, the antenna 3086*a* of the antenna module 3086 and the hollowed area 3084*a* of the plate 3084 are integrally formed in one piece. In an embodiment, the dimension of the hollowed area 3084*a* may correspond to the dimension of the antenna module 3086, but the invention is not limited thereto.

In an embodiment, the plate 3084 of the mask 308 is tightly disposed on the sidewalls 1040 of the frame 104 (illustrated in FIG. 2B), such that the mask 308 can be fixedly disposed and surrounding the outer sides of the sidewalls 1040 of the frame 104. Thus, the sidewalls 1040 of the frame 104 can cover the hollowed area 3084*a* of the plate 3084, and the structure of the mask 308 and the frame 104 can completely isolate electromagnetic waves to avoid electromagnetic interference being generated between the elements inside and the elements outside the mask 308.

To summarize, the communication device of the embodiment of the disclosure has a mask, is integrally formed in one piece with the mask and an antenna. Therefore, the antenna assembly step in the manufacturing process can be omitted, and only the antenna and the electromagnetic mask integrally formed in one piece are required to be tested. The antenna and the product on which the antenna is installed is not required to be tested, and the manufacturing cost can thus be reduced. In an embodiment, the body of the mask is used as a reference ground surface of the radiation element to increase the efficiency of radiation. In addition, a larger-area mask improves the dissipation effect of the chip.

In an embodiment, the mask contacts the communication chip to achieve the dissipation effect, such that the functions of antenna operation, electromagnetic wave shielding and heat dissipation can be achieved. In an embodiment, the structure of the mask and the sidewalls provides shielding effect to avoid the antenna being affected by noise coupling, such that the trace of antenna is free from the limitation of noise area and the difficulty assembly can be reduced.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A communication device, comprising:

a circuit board;

a frame disposed on an upper surface of the circuit board and having a plurality of sidewalls perpendicular to the upper surface and surrounding an opening;

a communication chip disposed on the upper surface and located in the opening; and a mask disposed on the circuit board, the mask comprises:

a cover covering the communication chip;

a plurality of plates projected from a lower edge of the cover, parallel to the sidewalls and having a hollowed area;

an antenna module connected to the hollowed area and integrally formed with the plates;

wherein the sidewalls of the frame cover the hollowed area; and wherein the antenna module comprises an antenna, and the antenna is bent around a bend line between the cover and one of the plates, and the antenna projects from an upper surface of the cover.

2. The communication device according to claim 1, wherein the antenna module is extended to the hollowed area.

3. The communication device according to claim 1, wherein the antenna module is a monopole, a dipole or a planar inverted F-type antenna.

4. The communication device according to claim 1, wherein the dimension of the hollowed area corresponds to the dimension of the entire antenna module.

5. The communication device according to claim 1, wherein the sidewalls of the frame are tightly disposed on the plate of the mask.

6. The communication device according to claim 1, wherein the hollowed area comprises a plurality of holes, and the antenna module comprises a plurality of the antennas, each of the antennas being connected to a corresponding hole of the holes.

7. The communication device according to claim 1, further comprising:

a fixing piece penetrating to the upper surface from a lower surface of the circuit board and fixed between the circuit board and the mask, such that the mask keep contacting the communication chip.

8. The communication device according to claim 1, further comprising:

a housing encapsulating the circuit board, the frame, the communication chip and the mask.

* * * * *